US010107549B2

(12) United States Patent
Bonnissel et al.

(10) Patent No.: US 10,107,549 B2
(45) Date of Patent: Oct. 23, 2018

(54) METHOD FOR LIQUEFYING A NATURAL GAS, INCLUDING A PHASE CHANGE

(71) Applicant: SAIPEM S.A., Montigny le Bretonneux (FR)

(72) Inventors: Marc Bonnissel, Montigny le Bretonneux (FR); Bertrand Du Parc, Voisins le Bretonneux (FR); Boris Bolosier, Montigny le Bretonneux (FR)

(73) Assignee: Saipem S.A., Montigny le Bretonneux (FR)

( * ) Notice: Subject to any disclaimer, the term of this patent is extended or adjusted under 35 U.S.C. 154(b) by 595 days.

(21) Appl. No.: 14/415,109

(22) PCT Filed: Jul. 4, 2013

(86) PCT No.: PCT/FR2013/051593
§ 371 (c)(1),
(2) Date: Jan. 15, 2015

(87) PCT Pub. No.: WO2014/013158
PCT Pub. Date: Jan. 23, 2014

(65) Prior Publication Data

US 2015/0184930 A1 Jul. 2, 2015

(30) Foreign Application Priority Data

Jul. 17, 2012 (FR) ..... 12 56888

(51) Int. Cl.
*F25J 1/02* (2006.01)
*F25J 1/00* (2006.01)
*F17C 13/08* (2006.01)

(52) U.S. Cl.
CPC ..... *F25J 1/0022* (2013.01); *F17C 13/082* (2013.01); *F25J 1/0055* (2013.01); *F25J 1/0214* (2013.01);
(Continued)

(58) Field of Classification Search
CPC ..... F25J 1/0214; F25J 1/0035; F25J 1/005; F25J 1/0292; F25J 1/0291; F25J 1/0209; F25J 1/0207; F25J 2205/90; F25J 2240/60
See application file for complete search history.

(56) References Cited

U.S. PATENT DOCUMENTS 3,855,810 A 12/1974 Simon et al.
4,339,253 A * 7/1982 Caetani ..... F25J 1/0022 62/114
(Continued)

FOREIGN PATENT DOCUMENTS

DE 2 206 620 8/1973
DE 197 16 415 10/1998
(Continued)

*Primary Examiner* — Brian King
(74) *Attorney, Agent, or Firm* — Cozen O'Connor

(57) ABSTRACT

Process for liquefying natural gas in a cryogenic heat exchanger by flowing in indirect contact with refrigerant fluid entering heat exchanger at a first inlet at temperature T0 and pressure P1, and flowing through the exchanger as co-current with the natural gas stream, leaving the heat exchanger in the liquid state, then being expanded at the cold end of the exchanger to return to gaseous state at a pressure P'1 P1 and temperature T1 T0, before leaving the hot end of exchanger by outlet orifice in gaseous state T0. The fluid is then reliquefied to the inlet of the exchanger via compression followed by partial condensation and phase separation, a first liquid phase taken to the first inlet, a first gaseous portion compressed by a second compressor and cooled in desuperheater by contact with portion of the first liquid phase, prior to condensing in a second condenser.

16 Claims, 4 Drawing Sheets

(52) U.S. Cl.
CPC ..... *F25J 1/0278* (2013.01); *F25J 1/0291* (2013.01); *F25J 1/0292* (2013.01); *F25J 1/0296* (2013.01); *F25J 2205/90* (2013.01); *F25J 2240/60* (2013.01)

(56) References Cited

U.S. PATENT DOCUMENTS

| | | | | |
|---|---|---|---|---|
| 6,158,240 | A * | 12/2000 | Low | F25J 1/0022 62/611 |
| 6,269,655 | B1 | 8/2001 | Roberts et al. | |
| 6,347,532 | B1 | 2/2002 | Agrawal et al. | |
| 2001/0042377 | A1* | 11/2001 | Pozivil | F17C 13/004 62/48.3 |
| 2007/0227185 | A1* | 10/2007 | Stone | F25B 9/006 62/611 |
| 2009/0241593 | A1* | 10/2009 | Jager | F25J 1/0022 62/613 |

FOREIGN PATENT DOCUMENTS

| | | |
|---|---|---|
| EP | 1 132 698 | 9/2001 |
| GB | 1 572 900 | 8/1980 |

* cited by examiner d1',P1,T0
T0,P0
d1",P0,T0
AA2
AA3
AA4
P'1,d1=d1'+d1"
AA
DS
d1e
EC1
AA1
S1
C1A
H1
gas
Sg
S1A
S1B
d1c
P"1
d1b
V1
6
BB2
R1
C1
BB
-50°C = T1
BB3
H0
d1d=d1'
d1a
PP
BB1
D1
D1A
P2,T0
CC1
T1,P2
d2,P2
CC2
CC
CC3
d2b
H2
EC2
S2A
S2
R2
LNG
+ gas
C2
DD3
DD2
d2a
6
DD
-120°C = T2
DD1
P'2

Sg
D2
EE
EC3
EE1
LNG
S3
6
FF1
FF
-165°C = T3
GG
D3

DS
3
1
d1b
4
V1
2
d1c

METHOD FOR LIQUEFYING A NATURAL GAS, INCLUDING A PHASE CHANGE

PRIORITY CLAIM

This is a U.S. national stage of application No. PCT/FR2013/051593, filed on Jul. 4, 2013. Priority is claimed on France Application No. FR 1256888 filed Jul. 17, 2012, the content of which is incorporated herein by reference.

BACKGROUND OF THE INVENTION

The present invention relates to a process for liquefying natural gas in order to produce liquefied natural gas (LNG). Still more particularly, the present invention relates to liquefying natural gas that comprises mostly methane, preferably at least 85% methane, with its other main constituents being selected from nitrogen, and C-2 to C-4 alkanes, namely ethane, propane, and butane.

The present invention also relates to a liquefaction installation located on a ship or a support floating at sea, either in open sea or in a protected zone such as a port, or indeed an installation on land for medium and large units for liquefying natural gas.

Methane-based natural gas is either a by-product of an oil field, being produced in small or medium quantities, in general in association with crude oil, or else a major product of a gas field, where it is obtained in combination with other gases, mainly C-2 to C-4 alkanes, $CO_2$, and nitrogen.

When small quantities of natural gas are associated with crude oil, the natural gas is generally treated and separated and then used on site as fuel in turbines or piston engines for producing electricity and for producing heat used in separation or production processes.

When the quantities of natural gas are large, or indeed very large, it is desirable to transport the gas so that it can be used in far-off regions, generally on other continents, and for this purpose the preferred method is to transport it in a cryogenic liquid state (−165° C.) substantially at ambient atmospheric pressure. Specialized transport ships known as methane tankers possess tanks of very large dimensions and extreme thermal insulation so as to limit evaporation during the voyage.

Gas is generally liquefied for transport purposes in the proximity of the site where it is produced, generally on land, and that operation requires large installations for reaching capacities of several thousands of (metric) tonnes (t) per year, with the largest presently existing plants combining three or four liquefaction units capable of producing 3 megatonnes (Mt) to 4 Mt per year and per unit.

That method of liquefaction requires large quantities of mechanical energy, with that mechanical energy generally being produced on site by taking a fraction of the gas in order to produce the energy needed for the liquefaction process. A portion of the gas is then used as fuel in gas turbines, in steam boilers, or in piston combustion engines.

Multiple thermodynamic cycles have been developed for optimizing overall energy efficiency. There are two main types of cycle. A first type is based on compressing and expanding a refrigerant fluid, with a change of phase, and a second type is based on compressing and expanding a refrigerant gas without a change of phase. The term "refrigerant fluid" or "refrigerant gas" is used to designate a gas or a mixture of gases circulating in a closed circuit and being subjected to stages of compression, possibly also of liquefaction, and to exchanges of heat with the surroundings, and then to stages of expansion, possibly also of evaporation, and finally to exchanges of heat with methane-containing natural gas for liquefying, which gas cools little by little to reach its liquefaction temperature at atmospheric pressure, i.e. about −165° C. for LNG.

Said first type of cycle, with a change of phase, is generally used for installations of large production capacity requiring a larger amount of equipment. Furthermore, refrigerant fluids, which are generally in the form of mixtures, are constituted by butane, propane, ethane, and methane, which gases are dangerous since in the event of a leak they run the risk of leading to explosions or large fires. Nevertheless, in spite of the complexity of the equipment required, they remain more efficient and they consume energy of about 0.3 kilowatt hours (kWh) per kilogram (kg) of LNG produced.

Numerous variants of that first type of process with phase change of the refrigerant fluid have been developed, and the various suppliers of technology or equipment have their own formulations of mixtures for association with specific pieces of equipment, both for so-called "cascade" processes in which the various refrigerant fluids used are single-component fluids and circulate in different flow circuit loops, and for so-called "mixed" cycle processes having multicomponent refrigerant fluid loops. The complexity of installations comes from the fact that in stages in which the refrigerant fluid is in the liquid state, and more particularly in separators and in connection pipes, it is necessary to install gravity collectors, also referred to herein as "separator tanks", for gathering together the liquid phase and sending it to the cores of heat exchangers where it then vaporizes on coming into contact with the methane for cooling and liquefying, in order to obtain LNG.

The second type of liquefaction process, i.e. a process without a change of phase in the refrigerant gas, comprises a Claude cycle or an inverse Brayton cycle using a gas such as nitrogen. That second type of process presents advantages in terms of safety since the refrigerant gas in the cycle, generally nitrogen, is inert, and therefore not combustible, and that is very advantageous when installations are concentrated in a small area, e.g. on the deck of a floating support located in open sea, where such equipment is often installed on a plurality of levels, one above the other, and on an area that is reduced to the bare minimum. Thus, in the event of refrigerant gas leaking, there is no danger of explosion and it then suffices to reinject the lost fraction of refrigerant gas into the circuit. In contrast, the efficiency of that second type is lower since it generally requires energy of the order of 0.5 kWh/kg of LNG produced, i.e. about 20.84 kW days per tonne.

SUMMARY OF THE INVENTION

In spite of the lower energy efficiency of the liquefaction process without change of phase in the refrigerant gas, it is preferred to the process with change of phase since the process with change of phase is more sensitive to variations in the composition of the gas for liquefying, namely natural gas made up of a mixture in which methane predominates. In a cycle with change of phase of the refrigerant fluid, in order to ensure that efficiency remains optimized, the refrigerant fluid needs to be adapted to the nature and composition of the gas for liquefying and the composition of the refrigerant fluid might need to be modified over time as a function of modifications in the composition of the mixture of natural gas for liquefying as produced by the oil field. For such processes with change of phase, refrigerant fluids are used that are made up of a mixture of components.

More particularly, the object of the present invention is to provide an improved process for liquefying natural gas with change of phase.

More particularly, the present invention provides a method of liquefying natural gas mainly comprising methane, in which said natural gas for liquefying is liquefied by causing a stream of said natural gas to flow through at least one cryogenic heat exchanger in indirect contact with at least one first stream of first refrigerant fluid comprising a first mixture of components flowing in at least one first closed loop with change of phase, said first stream of first refrigerant fluid entering at a temperature substantially equal to the temperature T0 at which the natural gas enters into said first heat exchanger and at a pressure P1, passing through the heat exchanger as a co-current (parallel-flow) with said stream of natural gas and leaving it in the liquid state, said first stream of first refrigerant fluid in the liquid state being expanded in a first expander at the cold end of said first heat exchanger to the gaseous state at a pressure P'1 less than P1 and to a temperature T1 less than T0, and then leaving it via its hot end in the gaseous state and substantially at a temperature T0, said first stream of first refrigerant fluid in the gaseous state then being subsequently reliquefied at least in part and taken to the hot inlet of said first heat exchanger in order to constitute the feed of said first stream of first refrigerant fluid in the liquid state, which thus circulates in a closed circuit, the liquefaction of said first stream of first refrigerant fluid in the gaseous state comprising at least compression in a compressor followed by at least condensation in a condenser prior to being taken substantially to the pressure P1 at the hot end inlet of said first heat exchanger for exchanging heat with said first stream of first refrigerant fluid in the liquid state.

A problem with the above-defined process with change of phase lies in the composition of the refrigerant mixture changing over a cycle because a fraction of the lighter components of the refrigerant fluids tends to disappear and/or needs to be reinjected as explained below in the detailed description with reference to FIGS. 1A and 1B.

More precisely, in such processes, it has been observed that the condensation of the gaseous phase downstream from the second condenser is not total. The fluid leaving the second condenser for recycling to the hot end of the first heat exchanger may be in a two-phase state with a small content of gaseous phase containing gases constituted by the lighter components of the refrigerant mixture, the liquid phase then having a higher concentration of heavier components. This small content of gas cannot be separated or recycled in simple manner and it therefore needs to be eliminated. This has the consequence of modifying the composition of the recycled liquid refrigerant fluid and thus leads to a rise in the lowest temperature T1 that can be reached during evaporation of the refrigerant liquid within the enclosure of the heat exchanger EC1. Unfortunately, said vaporization constitutes the main thermodynamic heat exchange involved during the cycle. In order to overcome that undesirable effect and conserve said lowest temperature T1, the pressure level needs to be increased, thereby leading to an increased consumption of energy, and consequently to a reduction in the overall efficiency of the installation, i.e. an increase in terms of kWh consumed per kg of liquefied gas produced.

U.S. Pat. No. 4,339,253 describes a phase change process in which the refrigerant fluid recycled to the hot end of a heat exchanger is recycled in the two-phase state.

EP 1 132 698 seeks to reliquefy gas evaporated from a liquid gas tank 4. For that purpose, it proposes mixing said evaporated gas with a portion of liquid gas within desuperheaters 32-38 and 44-46 in order to cause the gas to be put back into solution. In EP 1 132 698 there are no condensers at the outlets from the desuperheaters.

The object of the present invention is thus to provide a process for liquefying natural gas with change of phase as defined above, which process is improved, serving in particular to solve the above-specified problem.

To do this, the present invention provides a process for liquefying natural gas comprising a majority of methane, preferably at least 85% methane, the other components essentially comprising nitrogen and C-2 to C-4 alkanes, in which said natural gas for liquefying is liquefied by causing a stream of said natural gas at a pressure P0 greater than or equal to atmospheric pressure, P0 preferably being greater than atmospheric pressure, to flow in at least one cryogenic heat exchanger in indirect contact with at least one first stream of a first refrigerant fluid comprising a first mixture of compounds circulating in at least one first closed circuit loop with change of phase, said first stream of first refrigerant fluid entering said first heat exchanger via a first inlet at a "hot" end at a pressure P1 and at a temperature substantially equal to the inlet temperature T0 of the natural gas entering said first heat exchanger, the refrigerant passing through the heat exchanger as a co-current with said natural gas stream and leaving it via a "cold" end in the liquid state, said first stream of first refrigerant fluid in the liquid state being expanded by a first expander at the cold end of said first heat exchanger in order to return to the gaseous state at a pressure P'1 less than P1 and at a temperature T1 less than T0 inside said first heat exchanger at its cold end, then leaving the first heat exchanger via an outlet orifice at its hot end in the gaseous state and substantially at a temperature T0, said first stream of first refrigerant fluid in the gaseous state then being reliquefied at least in part and taken to the first inlet at the hot end of said first heat exchanger to constitute the feed of said first stream of first refrigerant fluid in the liquid state thus circulating in a closed circuit, the liquefaction of said first stream of first refrigerant fluid in the gaseous state comprising first compression in a first compressor followed by first partial condensation in a first condenser, and phase separation in a first separator tank separating a first liquid phase of first refrigerant fluid and a first gaseous phase of first refrigerant fluid, said first liquid phase of first refrigerant fluid at the low outlet from said first separator being taken by a pump substantially at the pressure P1 at least in part to said first inlet at the hot end of said first heat exchanger in order to constitute said first stream of first refrigerant fluid in the liquid state, said first gaseous phase of said first refrigerant fluid at the high outlet from said first separator being compressed substantially to the pressure P1 by a second compressor and then condensed at least in part in a second condenser, preferably after being mixed with at least one portion of said first liquid phase of first refrigerant fluid.

According to the present invention, said first gaseous phase of said first refrigerant fluid at the outlet from said second compressor is cooled in a desuperheater by coming into contact with a portion of said first liquid phase of first refrigerant fluid at the outlet from said first separator, said portion of first liquid phase of the first refrigerant fluid being micronized and vaporized, preferably being entirely vaporized, within said desuperheater, prior to said condensation in said second condenser.

Preferably, said portion of first liquid phase of first refrigerant fluid represents less than 10% by weight of the flow, more preferably 2% to 5% of the total flow of said first total liquid phase of first refrigerant fluid, so as to be vaporized entirely within said desuperheater, and so that the first refrigerant fluid at the outlet from said desuperheater is entirely in the gaseous phase prior to being at least partially condensed in said second condenser, the flow of said first liquid phase portion of first refrigerant fluid being adjusted with the help of at least one control valve.

The vaporization of said first and second streams of first refrigerant fluid by said first and second expanders constitutes the main part of the heat exchange within said first cryogenic heat exchanger by cooling said first and second streams of first refrigerant fluid in the gaseous state within said first heat exchanger and causing heat to be absorbed, and cooling said natural gas streams to the temperature T1 less than T0, and thus cooling said first and second streams of first refrigerant fluid in the liquid state.

The micronizing (also known as "atomizing") of said first liquid phase of first refrigerant fluid increases the contact area between the particles of liquid and the gas into which said liquid phase is sprayed, thereby enhancing its evaporation and absorption of heat, and cooling of said first gaseous phase of first refrigerant fluid. Micronizing a controlled quantity constituting a small portion of said first liquid phase of first refrigerant fluid thus enables it to be converted entirely to the gaseous state and cools said first gaseous phase of first refrigerant fluid, which remains entirely in the gaseous state. The pre-cooling of said gaseous phase of first refrigerant fluid by mixing with a portion of the liquid phase micronized within the desuperheater is advantageous in that it enables a larger fraction of the gaseous phase to condense in said second condenser, and possibly enabling all of it to condense.

In addition, said first gaseous phase of said first refrigerant fluid at the outlet from said first separator tank is more easily condensed in said second condenser after mixing with at least one portion of said first liquid phase of first refrigerant fluid after micronizing and vaporizing, since said resulting gaseous phase is condensable at a temperature that is higher and at a pressure that is lower than the temperature and pressure required in the prior art, and thus requiring less power to drive said second compressor.

In a first variant implementation, as described more completely below with reference to FIG. 3, said gaseous phase of first refrigerant fluid cooled at the outlet from said desuperheater is condensed in part in said second condenser, and then a second phase separation is performed in a second separator tank separating a second liquid phase of first refrigerant fluid from a second gaseous phase of first refrigerant fluid, said second liquid phase of first refrigerant fluid at the low outlet from said second separator tank being mixed with the remainder of said first liquid phase of first refrigerant fluid and taken to said first inlet at the hot end of said first heat exchanger to form said first stream of first refrigerant fluid in the liquid state substantially at the temperature T0 and substantially at said pressure P1, and said second gaseous phase at the high outlet from the second separator tank being taken at said pressure P1 and said temperature of substantially T0 to a second inlet at the hot end of said first heat exchanger to form a second stream of first refrigerant fluid passing through said first heat exchanger in the gaseous state as a co-current with said stream of natural gas, and leaving it in the gaseous state and being expanded by a second expander at the cold end of said first heat exchanger to return to the gaseous state at a pressure P'1 less than P1 and at a temperature T1 less than T0 inside said first heat exchanger beside its cold end, and then leaving via said outlet orifice at its hot end in the gaseous state and substantially at a temperature T0, to be taken subsequently to said first compressor with said first stream of first refrigerant fluid in the gaseous state at the outlet from the hot end of said first heat exchanger.

The above implementation (FIG. 3) is preferred since firstly it enables said first liquid phases of first refrigerant fluid to be mixed to form said first stream under good conditions of stability, and secondly it does not require a total condenser to be used.

In a second variant implementation that is described more fully below with reference to FIG. 2, said gaseous phase of first refrigerant fluid cooled in said desuperheater is totally condensed in said second condenser, and is then taken in the liquid state substantially at said pressure P1 and at said temperature T0 to the hot end of said first heat exchanger to pass through said first heat exchanger as a co-current with said stream of natural gas mixed with said first stream of first refrigerant fluid in the liquid state, or preferably to form a second stream of first refrigerant fluid in the liquid state passing through said first heat exchanger as a co-current with said natural gas stream and leaving it in the liquid state and being expanded by a second expander at the cold end of said first heat exchanger in order to return to the gaseous state at a pressure P'1 less than P1 and at a temperature T1 less than T0 inside said first heat exchanger beside its cold end, and then leaving it via its outlet orifice at the hot end in the gaseous state and substantially at a temperature T0 in order to be taken to said first compressor with said first stream of first refrigerant fluid in the gaseous state at the outlet from the hot end of said first heat exchanger.

Still more particularly, said natural gas leaving the cold end of said first heat exchanger at a temperature substantially equal to T1 is cooled and at least partially liquefied in at least one second cryogenic heat exchanger, in which said natural gas for liquefying is liquefied by causing the stream of said natural gas to flow in indirect contact with at least one first stream of a second refrigerant fluid comprising a second mixture of compounds flowing in at least one second closed circuit loop with phase change, said second stream of refrigerant fluid entering into said second heat exchanger at a first inlet at the "hot" end of said second heat exchanger at a temperature substantially equal to T1 and at a pressure P2, passing through said second heat exchanger as a co-current with said stream of natural gas, and leaving it at a temperature in the liquid state at a "cold" end of said second heat exchanger, said first stream of second refrigerant fluid in the liquid state being expanded by a third expander at the cold end of said second heat exchanger in order to return to the gaseous state at a pressure P'2 less than P2 and at a temperature T2 less than T1 within said second heat exchanger beside its cold end, and then leaving via an outlet orifice at the hot end of said second heat exchanger in the gaseous state substantially at a temperature T1, said first stream of second fluid in the gaseous state then being partially reliquefied and taken to the inlet at the hot end of said second heat exchanger in order to constitute the feed of said first stream of second cooling fluid in the liquid state thus circulating in a closed loop, the liquefaction of said first stream of second refrigerant fluid in the gaseous state comprising compression to a pressure P2 by a third compressor and then cooling substantially to T0 in a cooling heat exchanger, with said first stream of second cooling fluid in the gaseous state then being taken to an inlet at the hot end of said first heat exchanger through which it passes in order to leave it via its cold end in the partially liquefied state substantially at the temperature T1, and then being subjected to phase separation in a third separator tank separating a liquid phase of second refrigerant fluid from a gaseous phase of second refrigerant fluid, the liquid phase of second refrigerant fluid at the low outlet from said third separator being taken substantially at the temperature T1 and the pressure P2 to said first inlet at the hot end of said second heat exchanger in order to form said first stream of second refrigerant fluid in the liquid state, said gaseous phase of said second refrigerant fluid at the high outlet from said third separator being taken to a second inlet at the hot end of said second heat exchanger substantially at the temperature T1 and at the pressure P2 in order to form a second stream of second refrigerant fluid passing through said second heat exchanger in the gaseous state and leaving at the cold end of said second heat exchanger prior to leaving from an outlet orifice at the hot end of said second heat exchanger in order to be taken to said third compressor with said first stream of second fluid in the gaseous state, preferably mixed together therewith.

In a preferred implementation, said natural gas leaving the cold end of said second heat exchanger at a temperature substantially equal to T2 and partially liquefied is cooled and fully liquefied at a temperature T3 lower than T2 in at least one third cryogenic heat exchanger, in which said natural gas flows in indirect contact as a co-current with at least one third stream of second refrigerant fluid fed by said second stream of second refrigerant fluid in the gaseous state leaving the cold end of said second heat exchanger substantially at the temperature T2 and at the pressure P2, said third stream of second refrigerant fluid passing in the gaseous state through said third heat exchanger as a co-current with said stream of liquefied natural gas and leaving it substantially in the gaseous state and being expanded by a fourth expander at the cold end of said third heat exchanger to return to the gaseous state at a pressure P2' less than P2 and at a temperature T3 less than T2 within said third heat exchanger beside its cold end, and then leaving it via an orifice at its hot end in the gaseous state and substantially at a temperature T2 in order subsequently to be taken to an orifice at the cold end of said second heat exchanger in order to leave it via an orifice at the hot end of said second heat exchanger in order to be taken to said third compressor together with said first stream of second fluid in the gaseous state, preferably mixed together therewith.

According to another particular characteristic, said expanders comprise valves with an opening percentage that is suitable for being controlled in real time.

Still more particularly, the compounds of the natural gas and of the refrigerant fluids are selected from methane, nitrogen, ethane, ethylene, propane, butane, and pentane.

Still more particularly, the composition of the natural gas for liquefying lies within the following ranges for a total of 100% of the following compounds:

methane 80% to 100%;
nitrogen 0% to 20%;
ethane 0% to 20%;
propane 0% to 20%; and
butane 0% to 20%.

Still more particularly, the composition of the refrigerant fluids lies within the following ranges for a total of 100% of the following compounds:

methane 2% to 50%;
nitrogen 0% to 10%;
ethane and/or ethylene 20% to 75%;
propane 5% to 20%;
butane 0% to 30%; and
pentate 0% to 10%.

Still more particularly, the temperatures have the following values:

T0: 10° C. to 60° C.;
T1: −30° C. to −70° C.;
T2: −100° C. to −140° C.; and
T3: −160° C. to −170° C.

Still more particularly, the pressures have the following values:

P0: 0.5 MPa to 10 MPa (substantially 5 bar to 100 bar);
P1: 1.5 MPa to 10 MPa (substantially 15 bar to 100 bar); and
P2: 2.5 MPa to 10 MPa (substantially 25 bar to 100 bar).

Advantageously, a process of the invention is performed on board a floating support.

The present invention also provides an installation on board a floating support for performing a process of the present invention, the installation being characterized in that it comprises:

at least one said first heat exchanger comprising at least:
- a first flow duct passing through said first heat exchanger and suitable for causing a first stream of first refrigerant fluid in the liquid state to flow therethrough;
- a second flow duct passing through said first heat exchanger and suitable for causing a said second stream of first refrigerant fluid in the gaseous or liquid state to flow therethrough; and
- a third duct passing through said first heat exchanger and suitable for causing said natural gas for liquefying to flow therethrough;

a first expander between the cold outlet of said first duct and a first inlet at the cold end of the enclosure of said first heat exchanger;

a second expander between the cold outlet of said second duct and a second inlet at the cold end of the enclosure of said first heat exchanger;

a first compressor with a connection pipe between an outlet at the hot end of the enclosure of said first heat exchanger and the inlet of said first compressor;

a first condenser with a connection pipe between the outlet of said first compressor and the inlet of said first condenser;

a first separator tank with a connection pipe between the outlet from said first condenser and said first separator tank;

a second compressor with a connection pipe between the top outlet from said first separator tank and the inlet of said second compressor;

a desuperheater with a connection pipe between the outlet from said second compressor and an inlet for admitting gas into said desuperheater;

a second condenser with a connection pipe between the outlet from said desuperheater and said second condenser;

a pump having a connection pipe between the bottom outlet from said first separator tank and said pump, and a connection pipe fitted with a first valve between the outlet from said pump and an inlet for admitting liquid into said desuperheater;

a connection pipe between the outlet from said pump and the inlet of said first duct for first refrigerant fluid; and a connection pipe between the outlet from said second condenser and the inlet of said second duct for first refrigerant fluid.

More particularly, an installation of the present invention further comprises:

a second separator tank with a connection pipe between the outlet from said second condenser and said second separator tank;

a connection pipe between the top outlet from said second separator tank and the inlet of said second duct for first refrigerant fluid;

a connection pipe between the bottom outlet from said second separator tank and the inlet of said first duct for first refrigerant fluid; and a connection pipe fitted with a second valve between firstly the outlet from said pump upstream from said first valve, and secondly a junction with said connection pipe between the bottom outlet from said second separator tank and the inlet of said first duct for first refrigerant fluid.

More particularly, an installation of the present invention further comprises:

a fourth duct passing through said first heat exchanger and suitable for causing a said second stream of second refrigerant fluid in the gaseous or liquid state to flow;

a second cryogenic heat exchanger comprising:

a first duct passing through said second heat exchanger suitable for causing a first stream of second refrigerant fluid in the liquid state to flow therethrough;

a second duct passing through said second heat exchanger suitable for causing a said second stream of second refrigerant fluid in the gaseous state to flow continuously therethrough; and a third duct passing through said second heat exchanger and suitable for causing said natural gas for liquefying to flow continuously through said third duct passing through said first heat exchanger;

a third heat exchanger comprising:

a first duct passing through said third heat exchanger and suitable for causing a said second stream of second refrigerant fluid in the gaseous state to flow continuously from said second duct passing through said second heat exchanger; and a second duct passing through said third heat exchanger suitable for causing said natural gas for liquefying to flow continuously from said third duct passing through said second heat exchanger;

a third separator tank;

a connection pipe between the cold end of said fourth duct of said first heat exchanger and said third separator tank;

a connection pipe between a bottom outlet from said third separator tank and an outlet orifice at the hot end of said second heat exchanger;

a connection pipe between a top outlet from said third separator tank and the hot end of said second duct of said second heat exchanger;

a third expander between the cold outlet from said first duct of said second heat exchanger and a first inlet at the cold end of the enclosure of said second heat exchanger;

a third compressor with a connection pipe between an outlet at the hot end of the enclosure of said second heat exchanger and the inlet of said second compressor;

a gas cooling heat exchanger with a connection pipe between the outlet from said second compressor and the inlet of said gas cooling heat exchanger;

a connection pipe between the outlet from said gas cooling heat exchanger and the inlet at the hot end of said fourth duct of said first heat exchanger;

a fourth expander between the cold end of said first duct of said third heat exchanger and an inlet at the cold end of the enclosure of said third heat exchanger; and a connection pipe between an outlet at the hot end of the enclosure of said third heat exchanger and a second inlet at the cold end of the enclosure of said second heat exchanger.

BRIEF DESCRIPTION OF THE DRAWINGS

Other characteristics and advantages of the present invention appear in the light of the following detailed description of various embodiments given with reference to the following figures.

DETAILED DESCRIPTION OF THE PRESENTLY PREFERRED EMBODIMENTS

Figure 1A:
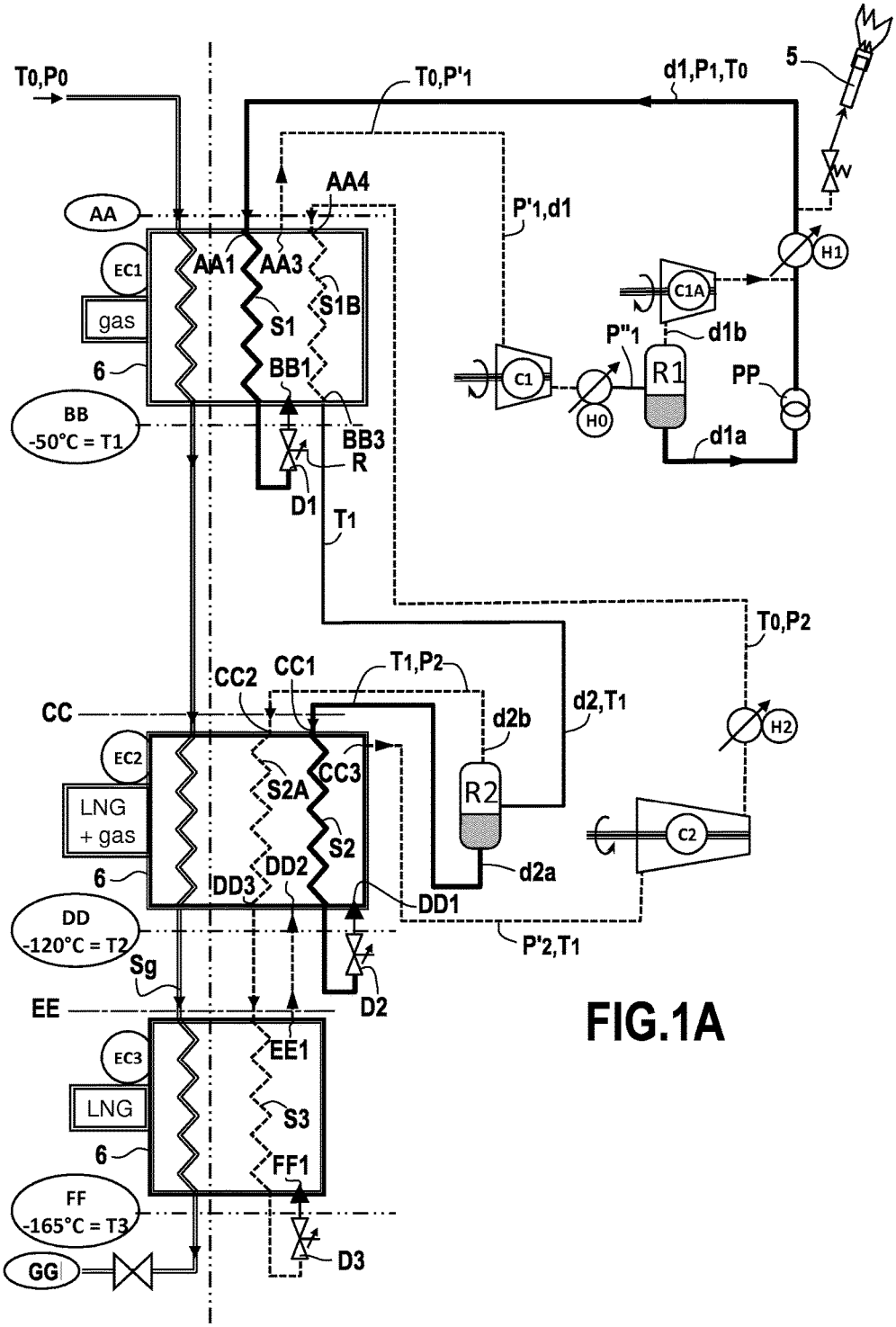
FIG. 1A is a diagram of a standard two-loop liquefaction process with change of phase, making use of coil cryogenic heat exchangers.

FIG. 1A is a process flow diagram (PFD), i.e. a diagram showing the streams in a standard dual-loop liquefaction process with change of phase known as a dual mixed refrigerant (DMR) process that uses as its refrigerant gases mixtures of gases that are each specific to a respective one of said two loops and that are referred to as the first refrigerant fluid and as the second refrigerant fluid, respectively, the two loops being totally independent of each other.

Natural gas flows in ducts of coil shape Sg passing successively through three cryogenic heat exchangers in series EC1, EC2, and EC3. Natural gas enters at AA into the first cryogenic heat exchanger EC1 at a temperature T0, greater than or substantially equal to ambient temperature and at a pressure P0 lying in the range 20 bar to 50 bar (2 megapascals (MPa) to 5 MPa). The natural gas leaves at BB at T1=−50° C. approximately. In this heat exchanger EC1, the natural gas is cooled but it remains in the gaseous state. Thereafter, it passes at CC into a second cryogenic heat exchanger EC2 of temperature lying in the range T1=−50° C. approximately at its hot end CC to T2=−120° C. approximately at its cold end DD. In this second heat exchanger EC2, all of the natural gas becomes liquefied as LNG at a temperature T2=−120° C. approximately. Thereafter, the LNG passes at EE into a third cryogenic heat exchanger EC3. In this third heat exchanger EC3, the LNG is cooled to the temperature T3=−165° C., thereby enabling the LNG to be discharged in the bottom portion at FF, and then enabling it to be depressurized at GG so as to be able finally to store it in liquid form at ambient atmospheric pressure, i.e. at an absolute pressure of about 1 bar (i.e. about 0.1 MPa). Throughout that passage of the natural gas along the circuit Sg through the various heat exchangers, the natural gas is cooled, delivering heat to the refrigerant fluid, which in turn become heated by vaporizing as described below and needs to be subjected continuously to complete thermodynamic cycles with change of phase in order to be able to extract heat continuously from the natural gas entering at AA.

Thus, the passage of the natural gas is shown on the left of the PFD where said natural gas flows downwards along the circuit Sg, its temperature decreasing on moving downwards, from a temperature T0 that is substantially ambient at the top at AA, to a temperature T3 of about −165° C. at the bottom at FF; the pressure being substantially equal to P0 down to the level FF of the cold outlet from the cryogenic heat exchanger EC3.

Figure 1B:
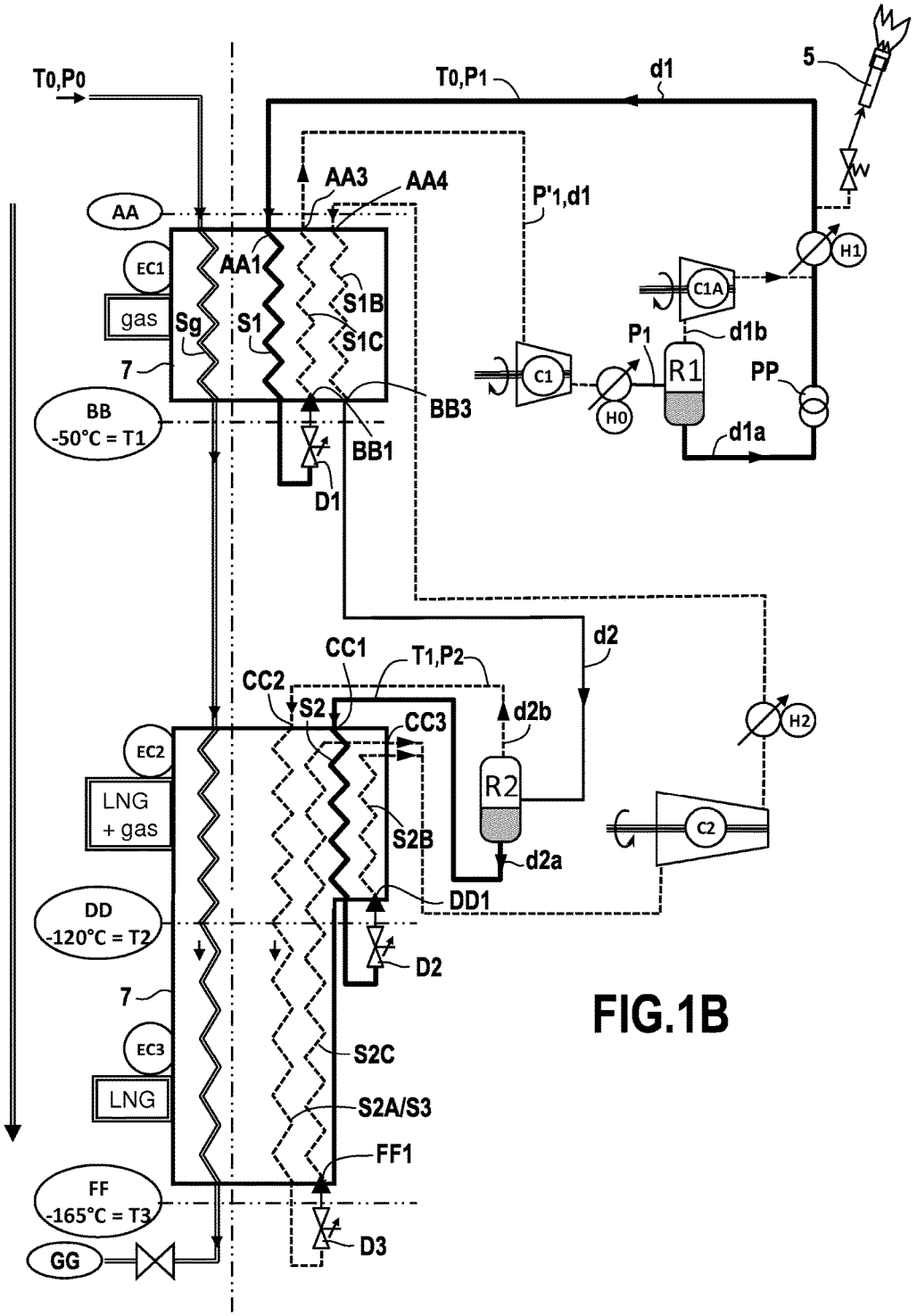
FIG. 1B shows a variant of FIG. 1A in which the second and third cryogenic heat exchangers C2 and C3 are in continuity and of the so-called "cold box" type (made of brazed aluminum plates)
Figures 2, 2A:
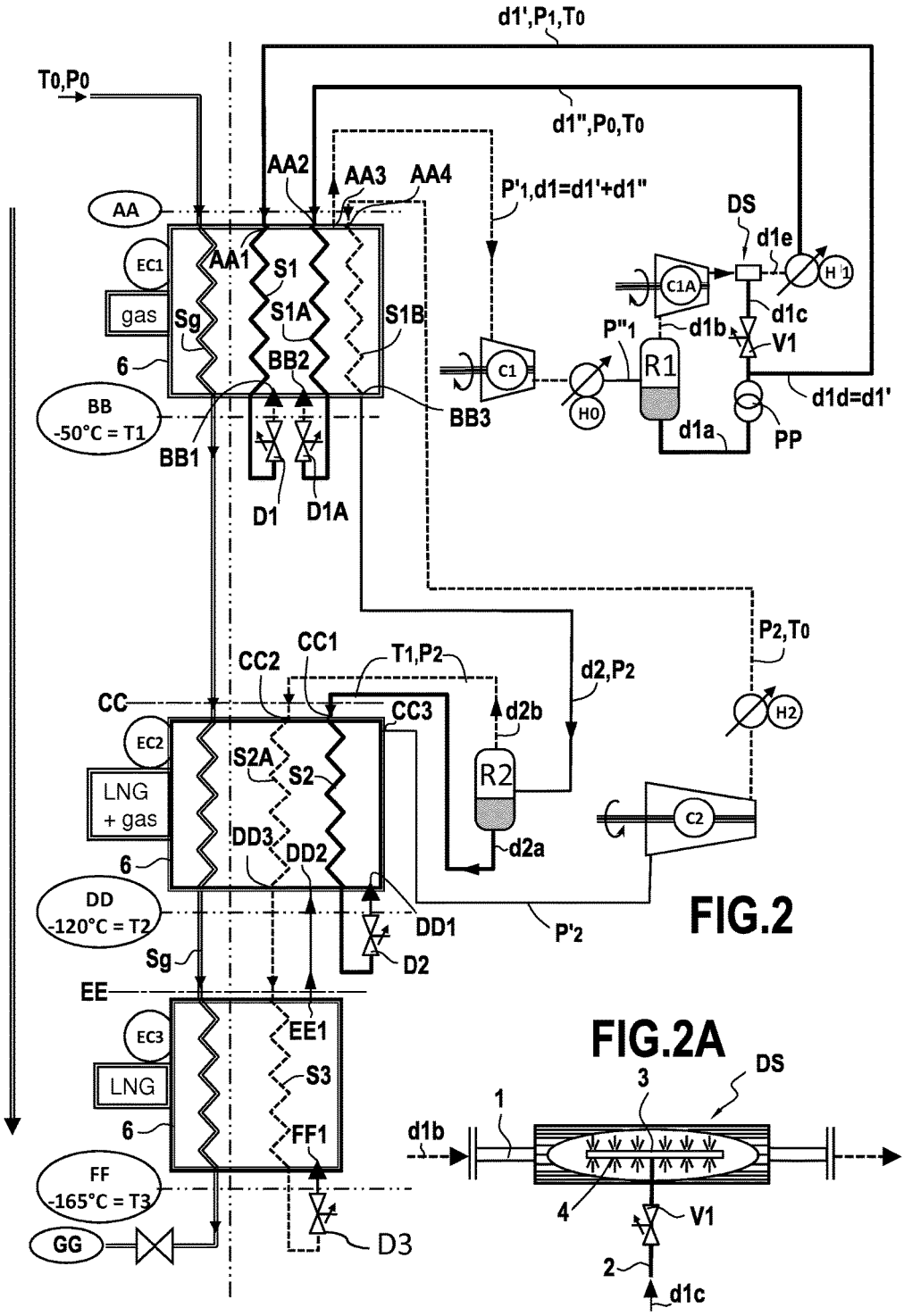
FIG. 2 is a diagram of a liquefaction process of the invention including a circuit in the primary refrigeration loop for recycling a portion of the refrigerant fluid in the liquid state to the portion of the refrigerant fluid in the gaseous state, in a desuperheater situated upstream from a refrigerant fluid condenser.
FIG. 2A is a cutaway side view showing a detail of the desuperheater of FIG. 2.
Figure 3:
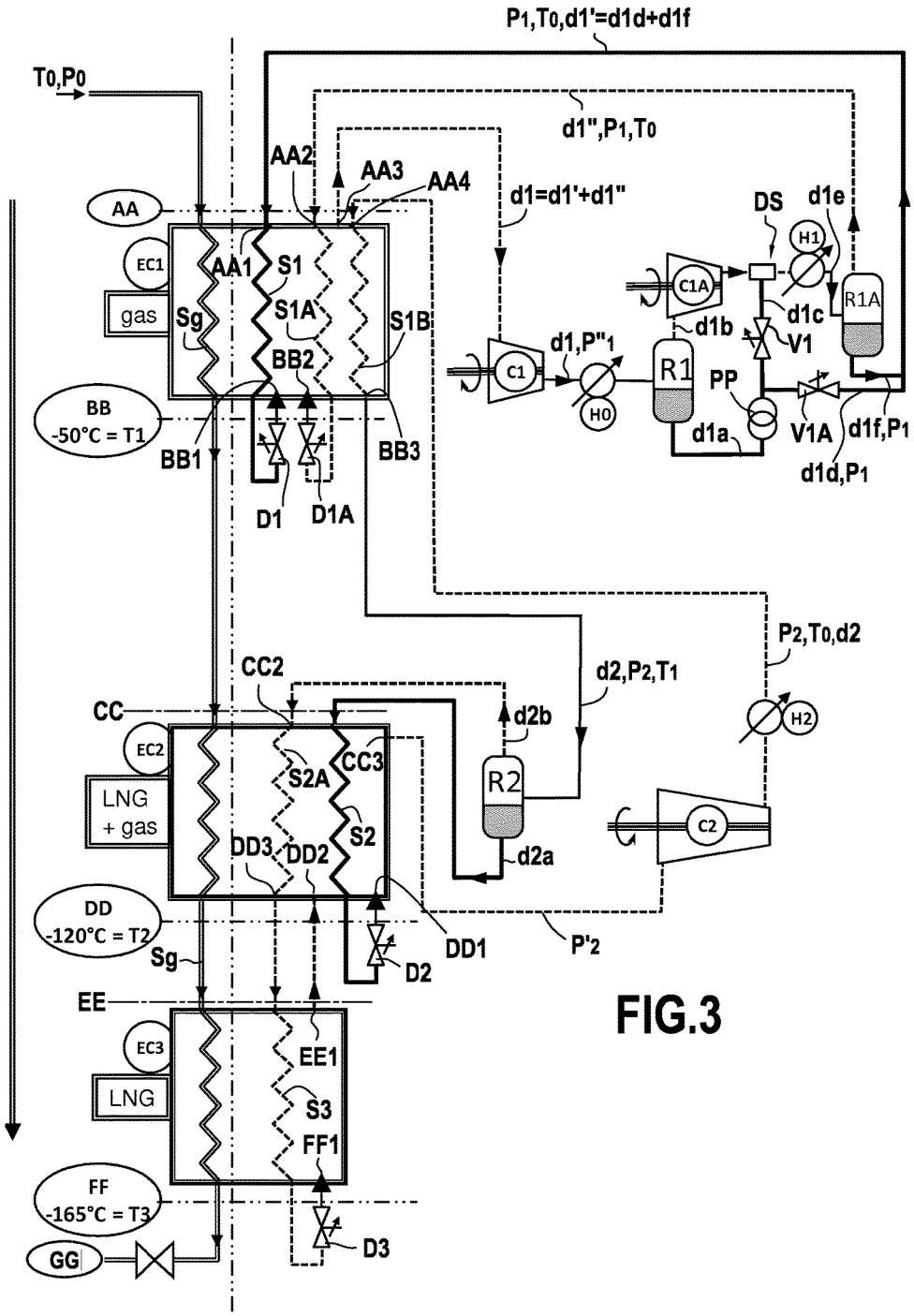
FIG. 3 is a diagram of a liquefaction process in a preferred version of the invention including a liquid phase and gas phase separator tank in the primary refrigeration loop downstream from the FIG. 2 condenser itself situated downstream from a desuperheater.

In FIGS. 1 to 3, to clarify explanation, the cold ends of the heat exchangers are physically closer to the bottom ends of said heat exchangers, and vice versa the hot ends of the heat exchangers are at their top ends. Likewise, to clarify explanation, the various phases of the refrigerant fluids are represented as follows:

liquid phases are represented by bold lines;

gaseous phases are represented by dashed lines; and two-phase phases are represented using ordinary lines.

In the right-hand portion of the PFD, there are shown the thermodynamic cycles to which the refrigerant fluids are subjected in the two loops, as described below.

In conventional manner, the cryogenic heat exchangers EC1, EC2, and EC3 are constituted by at least two fluid circuits that are juxtaposed but that do not communicate fluids between each other, the fluids flowing in said circuits exchanging heat all along their passage through the said heat exchanger. Numerous types of heat exchanger have been developed for various industries, and in the context of cryogenic heat exchangers, two main types are known: firstly coil heat exchangers and secondly heat exchangers using brazed aluminum plates, and commonly referred to as "cold boxes".

The description of the invention with reference to FIGS. 1A, 2, and 3 makes reference to heat exchangers EC1, EC2, and EC3 of the coil type. Coil heat exchangers of this type are known to the person skilled in the art and sold by the suppliers Linde (Germany) or Five Cryogénie (France). Such heat exchangers comprise a leaktight and lagged enclosure 6, and the natural gas and the refrigerant fluids flow therein in pipes of coiled shapes Sg, S1, and S2, said coils being arranged in said enclosure that is leaktight and lagged relative to the outside in such a manner that heat is exchanged between the inside volume of the enclosure and the various coils with a minimum of heat losses to the outside, i.e. to the ambient medium. In addition, gases and liquids may be respectively expanded or vaporized directly within the enclosure rather than in a duct inside the enclosure and as described below.

FIG. 1B shows a variant of FIG. 1A in which the cryogenic heat exchangers are of the plate heat exchanger type: all of the circuits are in thermal contact with one another in order to exchange heat, but the leaktight and lagged enclosure 6 seeks merely to thermally insulate the various ducts it contains, with no fluid being introduced therein directly, all of the fluids that flow therein thus being prevented from mixing. Heat exchangers of this "cold box" type are known to the person skilled in the art and they are sold by the supplier Chart (USA).

The process has a first loop referred to as a primary loop or a primary mixed refrigerant (PMR) loop that is made up as follows. A flow d1 of a first stream of the first refrigerant fluid enters the first cryogenic heat exchanger EC1 at its cold end AA at a point AA1 where its temperature is substantially equal to T0 and at a pressure P1, where P1 lies for example in the range 1.5 MPa to 10 MPa. Said first refrigerant fluid passes in the liquid state into the first heat exchanger EC1 in a first pipe of coil shape S1. The first stream of refrigerant fluid leaves the heat exchanger EC1 at BB at a temperature T1 of −50° C. approximately, prior to being directed to a first expander D1 that is constituted by a servo-controlled valve, said valve being in communication at BB1 with the inside of the enclosure 6 of the first heat exchanger EC1 beside the cold end of the heat exchanger EC1. Because of its expansion to a pressure P'1 less than P1, where P'1 lies in particular in the range 2 MPa to 5 MPa, the liquid of the first refrigerant fluid vaporizes, absorbing heat from the natural gas circuit Sg and heat from the other circuits of the first loop within the first heat exchanger as described below, and also, where appropriate, heat from the duct forming part of the second loop as described below, or indeed other loops when using multiple loop circuits referred to as multiple mixed refrigerant (MMR) circuits.

The first refrigerant fluid in the gaseous state at BB1 passes through the enclosure as a countercurrent and leaves the enclosure of the first heat exchanger EC1 at AA3 at its hot end AA, while still in the gaseous state and substantially at a temperature T0. Said first stream of refrigerant fluid in the gaseous state is then reliquefied and taken to the hot inlet AA1 of said first heat exchanger EC1 in order to constitute the feed of a said first stream of first refrigerant fluid in the liquid state to the inside of the duct S1, thus circulating around a closed circuit.

For this purpose, the stream of the first refrigerant fluid leaving the cold end of the enclosure of the first heat exchanger EC1 at AA3 while in the gaseous state is initially compressed from P'1 to P"1, where P"1 lies in the range P'1 to P1, in a first compressor C1, and is then condensed in part in a first condenser H0. The two-phase mixture of the first refrigerant fluid leaving the first condenser H0 is subjected to phase separation in a first separator tank R1. A first liquid phase of the first refrigerant fluid is extracted from the bottom of the first separator tank R1 and redirected as a flow d1*a* and at a pressure substantially equal to P1 by means of a pump PP to the inlet of a second condenser H1. A gas phase of the first refrigerant fluid is extracted from the top end of the separator tank R1 and is compressed substantially to the pressure P1 as a flow d1*b* by a second compressor C1A, the temperature at the outlet from said compressor being about 80° C. to 90° C. To facilitate condensation of this gaseous phase d1*b*, it is mixed with the liquid phase d1*a* prior to introducing the two-phase mixture d1 that is obtained into the second condenser H1.

In the prior art embodiment shown in FIGS. 1A and 1B, the condensation of the gaseous phase at the outlet from the second condenser H1 is not total and the fluid leaving it may still be a two-phase fluid. The gas that it contains gives rise to a rise in the pressure of the refrigerant fluid. However since the pipes are designed to operate at some given maximum pressure, a safety valve is generally inserted that is rated at a pressure slightly below the limit pressure that can be tolerated by the pipes, said valve (not shown) being connected to a flare 5, serving to eliminate the discharged gas by combustion, given that the quantities involved are small compared with the mass of refrigerant fluid in the loop. This gives rise to a problem because the fraction of gas that is sent to the flare is richer in the lighter components of the mixture constituting the first refrigerant fluid, thereby having the consequence of modifying the composition of the refrigerant mixture and thus of modifying the lowest temperature T1 that is reached on vaporizing the liquid refrigerant fluid in the first expander D1 within the enclosure of the first heat exchanger EC1.

In that primary loop, the composition of the refrigerant mixture is generally determined in terms of alkane components C1, C2, C3, and C4 in the manner described below in order to reach a lowest temperature T1 of about −50° C. However, once a lighter portion of the components has been eliminated, the composition of the mixture changes and its lowest temperature T1 then becomes −40° C. or −45° C., or even −35° C. This results in a drop in the efficiency of the primary loop and thus in a drop in the overall efficiency of the liquefaction process.

In an improved variant of FIGS. 1A and 1B, an additional accumulator tank R'1 (not shown) is included downstream from the condenser H1 with the function of receiving a liquid phase, and where appropriate a multiphase phase so that the gas contained in the multiphase phase collects in the top portion of said accumulator tank, where it is trapped, the liquid phase contained in R'1 being taken from the bottom of said accumulator tank and being directed to EC1. If the quantity of gas in R'1 increases, the pressure within R'1 increases and said gas condenses and mixes with the liquid phase before being discharged to the cryogenic heat exchanger EC1. When the pressure of the gas reaches a limit value, a valve opens and releases a portion of the gas to the flare 5 so that its pressure drops back to an acceptable level, thereby preventing the gas from reaching the low point from which liquid phase is taken from said accumulator tank, where it would produce a two-phase mixture with said liquid phase, and where expansion of that mixture in the expander D1 presents a difficult problem. However, under all circumstances, the liquid phase leaving R'1 and recycled through S1 presents a composition having a content of lighter components that is either unchanged or else that is decreased.

The adaptations to the primary loop of the present invention as described below with reference to FIGS. 2 and 3 make it possible to overcome the problem of instability and of deterioration in the overall efficiency of the above-described liquefaction process that results therefrom.

The embodiments of FIGS. 1 to 3 include a second loop of a refrigerant fluid that co-operates with all three cryogenic heat exchangers EC1, EC2, and EC3, as described below.

At the cold outlet BB from the cryogenic heat exchanger EC1, the natural gas at temperature T1 is partially liquefied and then passes into the second cryogenic heat exchanger EC2, which it leaves at the temperature T2 while partially liquefied, prior to being cooled and liquefied completely at a temperature T3 in the third cryogenic heat exchanger EC3. A second mixture of refrigerant fluid flows in a second closed circuit loop with phase change as follows. The second refrigerant fluid reaches the hot end CC of EC2 at CC1 while in the liquid state at the temperature T1 and at the pressure P2, where P2 lies for example in the range 2.5 MPa to 10 MPa. The second refrigerant fluid in the liquid state passes through the second heat exchanger EC1 in a coil-shaped duct S2 as a countercurrent to the natural gas fluid in Sg. This first stream of second refrigerant fluid in the liquid state as a flow d2*a* is then expanded in an expander D2 at the cold end DD of the second heat exchanger EC2 at a point DD1 to a pressure P'2 less than P2 and at a temperature T2 less than T1, inside the enclosure of the second heat exchanger EC2. Thereafter, this first stream of second refrigerant fluid leaves the second enclosure via an orifice CC3 at the hot end of the second heat exchanger EC2, while in the gaseous state and substantially at a pressure P'2 and a temperature T1. This stream of second refrigerant fluid in the gaseous state is then compressed from P'2 to P2 in a compressor C2 that it leaves at a temperature lying in the range 80° C. to 100° C., approximately, prior to being cooled in a temperature cooling heat exchanger H2 that it leaves while still in the gaseous state and at a temperature substantially equal to T0 (20° C. to 30° C.) This second refrigerant fluid gas is then taken at AA4 to the hot end AA of the first cryogenic heat exchanger EC1 in order to be cooled on passing through it in a coil-pipe type S1B that it leaves at BB3 at the cold end BB of the first heat exchanger EC1 at a temperature T1=−50° C. approximately and in a multiphase state, i.e. a partially-liquefied state, as a flow d2 in order to be separated in a second separator tank R2, where it is separated into a liquid phase and a vapor phase. The liquid phase is sent as a flow d2*a* via CC3 to the hot end CC of the second heat exchanger EC2 in order to constitute the feed of said first stream of the second refrigerant fluid in the liquid state within the coil S2 for the purpose of performing a new cycle as described above. The vapor phase flow d2*b* leaving the second separator tank R2 is likewise taken to the hot end CC of the second heat exchanger EC2 at substantially T1 and substantially P2 in order to feed via CC2 another coil-shaped duct S2A within the second heat exchanger EC2. The gaseous stream d2*b* of the second refrigerant fluid leaves via DD3 in the vapor state at a pressure substantially equal to P2 and at a temperature T2=−120° C. approximately in order to be taken to the hot end EE of the third cryogenic heat exchanger EC3, still at T2=−120° C. approximately, within which heat exchanger it is cooled in a coil-shaped duct S3. The refrigerant fluid leaves the duct S3 at FF while still in the gaseous state at a pressure of substantially P2 and at a temperature T3=−165° C. approximately prior to being expanded to P'2 less than P2 in an expander D3 directly within the enclosure EC3 at a cold end via FF1 in order to leave it at its hot end via EE1 at approximately a pressure P2 and a temperature T2=−120° C. and being taken to the cold end of the second enclosure EC2 via DD2. This second stream d2*b* of second refrigerant fluid in the gaseous state is then in a mixture with the first stream d2*a* of the second refrigerant fluid vaporized to the gaseous state on expanding in the expander D2 at DD1, the mixture of the two gases leaving the second heat exchanger EC2 as a flow d2=d2*a*+d2*b* via CC3 in order to perform a new cycle through the compressor C2 and the cooler E2, as described above.

In FIG. 1B, the cryogenic heat exchangers are cold box heat exchangers as described above and the gases from the fluid vaporized by the expanders D1, D2, and D3 are channeled via coil-shaped ducts S1C, S2B, and S2C respectively within the first heat exchanger EC1, the second heat exchanger EC2, and the third heat exchanger EC3 in order to leave at the hot end of the first heat exchanger EC1 via AA3 and at the hot end of the second heat exchanger EC2 at CC3.

In FIG. 1B, the second and third heat exchangers EC2 and EC3 together with said pipes S2A and S3 are in continuity from the hot end CC of the second heat exchanger EC2 to the cold end FF of the third heat exchanger EC3. The return of the gaseous phase from the expander D3 via FF1 to the cold end of the third heat exchanger via the outlet CC3 at the hot end of the second heat exchanger EC2 takes place in a coil-shaped duct S2C. Likewise, the return of the gaseous phase from the expander D2 via DD1 at the cold end of the second heat exchanger in DD1 going to CC3 at the hot end of the second heat exchanger takes place in a coil-shaped pipe S2B.

In FIGS. 2 and 3, there are shown two variant implementations of the process of the invention. The modifications relative to the prior art process shown in FIGS. 1A and 1B lie in the first loop of the first refrigerant fluid.

In FIG. 2, the liquid phase of the first refrigerant fluid at the pressure P1 and as a flow d1*a* leaving the first separator tank R1 is split into two streams or flows d1*c* and d1*b*=d'1, with only the liquid portion of the flow d'1 being sent directly to the hot end AA of the first heat exchanger EC1 in order to constitute the feed of the first stream of liquid first refrigerant fluid in the duct S1. A portion of the flow d1*c* representing a mass ratio lying in the range 2% to 5% relative to the initial flow d1*a* is sent into a desuperheater DS, the gaseous phase d1*b* leaving the second compressor C1A also going to the inlet of the desuperheater DS that operates as described below. The liquid fraction of the flow d1*c* sent to the desuperheater DS is adjusted by the combined action of the servo-control valve V1 and of the first expander D1 as described below. This fraction d1*c* represents 2% to 10%, preferably 3% to 5% of the flow d1*a* from the pump PP.

FIG. 2A is a cutaway side view of the desuperheater DS which serves to cool the gaseous phase d1*b* before it enters the condenser H1. The desuperheater DS is constituted in conventional manner by a gas inlet pipe 1 connected to an internal strip 3 in the form of a perforated tube having a plurality of small-section orifices 4 distributed along and at the periphery of said strip. A pipe 2 bringing in liquid from the pump PP delivering a flow d1*c* that is controlled by the servo-control valve V1 serves to feed the strip 3 with liquid so as to create a mist of fine liquid droplets leaving the orifices 4 because of the pressure causing the liquid to be spread through said strip 3. The fine droplets of liquid then present a large specific surface area for exchange with the gaseous phase arriving via the feed pipe 1. The latent heat of evaporation of the liquid phase then has the effect of cooling the incoming gaseous phase. Said gaseous phase presents a temperature at the inlet to the desuperheater DS of about 80° C. to 90° C., and its temperature at the outlet from the desuperheater is no more than 55° C. to 65° C. because of the heat absorbed by vaporizing the liquid fluid d1*c*. The quantity of liquid d1*c* injected into the desuperheater DS is adjusted accurately so that all of the stream leaving the desuperheater DS is in the gaseous state and thus presents a homogeneous composition of gases.

A desuperheater DS of this type is sold by the supplier Fisher-Emerson (France).

In FIG. 2, the first refrigerant fluid leaving the desuperheater DS is thus entirely in the gaseous state at a temperature of about +55° C. to +65° C. prior to being fully condensed in a said second condenser H1, which in this example is a total condenser. At the outlet from the second condenser H1, the first refrigerant fluid is entirely in the liquid state and represents a flow d1' that is taken at the temperature T0 and substantially at the pressure P1 to the hot inlet AA2 of the first heat exchanger EC1 through which it passes within a coil-shaped duct S1A as a co-current with the fluid passing through the coil-shaped pipes Sg and S1 and S1B, prior to being taken to a second expander D1A likewise constituted by a servo-control valve, the second expander D1A being in communication with the inside of the heat exchanger EC1 via its cold end at BB2. At this level, the second stream of the first refrigerant fluid in the liquid state vaporizes, thereby absorbing heat from the natural gas duct Sg and also absorbing heat from the streams of the duct S1, of the duct S1A, and of the duct S1B.

In FIG. 2, the first stream or flow d1' and the second stream or flow d1" of the first refrigerant fluid as vaporized at BB1 and at BB2 by the first expander D1 and by the second expander D1A respectively at the cold end and inside the first enclosure EC1 mix together inside said enclosure of the heat exchanger EC1. This mixture leaves its hot end via AA3 to form the stream or flow d1=d1'+d1" of gas of the first refrigerant fluid that is then compressed in the first compressor C1 from P'1 to P"1 in order to be subjected to a new cycle, as described above.

This implementation of FIG. 2 is advantageous since during the pre-cooling of the first gas stream in the desuperheater DS, the light gas coming from the tank R1 becomes mixed with vapor coming from a heavy liquid phase d1*c*, and the resulting mixture is then heavier than the incoming gas phase on its own, thereby facilitating condensation in H1 and enabling condensation to be total and more efficient.

The fact that the first stream or flow d1' and the second stream or flow d1" of the first refrigerant fluid in the liquid state respectively leaving the second condenser H1 and the pump PP as described above are not mixed together before passing through the first heat exchanger EC1, but rather pass through the first heat exchanger EC1 in two separate ducts S1 and S1A is also advantageous, since the two streams present different compositions of the first refrigerant fluid, and they are also at different pressures. Thus mixing them would lead to instabilities that are more problematic than those in the prior art. Nevertheless, it is possible to control the mixing of said two liquid streams using appropriate regulation systems, e.g. control valves, but that would go against the simplicity and the reliability desired in an installation of this type.

FIG. 3 shows a preferred variant implementation of the invention, in which the second condenser H1 is not a total condenser, with only a portion of the gas stream leaving the desuperheater DS being condensed in the second condenser H1. The two-phase fluid leaving the second condenser H1 at a flow die is subjected to phase separation in a second separator tank R1A within which a second liquid phase and a second gaseous phase of the first refrigerant fluid are separated.

In FIG. 3, the second liquid phase of refrigerant fluid from the low outlet of R1A is taken to the duct S1 and represents a flow d1*f*. The flow d1*a* at the outlet from the pump PP is separated into two flows, respectively d1*c* to the desuperheater DS, which flow is adjusted by the first control valve V1, and a residue did that is adjusted by a second control valve V1A, said two control valves being controlled closely in combination with each other; said residue did is then mixed with the liquid flow d1*f* and taken to the pipe S1 at the hot end of the cryogenic heat exchanger EC1, substantially at the pressure P1.

In FIG. 3, the second gaseous phase of the first refrigerant fluid leaving the high outlet of the second separator tank R1A represents a flow d1". It is taken at the temperature T0 and substantially at the pressure P1 to the inlet AA2 at the hot end AA of the first heat exchanger EC1 in order to pass through it in the duct S1A while in the gaseous state and not in the liquid state as in the implementation of FIG. 2. At the cold end of the duct S1A at BB2, the second expander D1A expands the gas of the second gaseous phase of the first refrigerant fluid to a pressure P1' less than P1. This expansion of the gas at BB2 from S1A by D1A then absorbs heat from Sg, S1, S1A, and S1B, thereby cooling them, and where appropriate absorbs heat from other loops if there are multiple loop circuits (referred to as MMR as mentioned above). The fluid in the liquid state leaving the second expander D1A via BB2 mixes with the first portion of the first refrigerant fluid vaporized at BB1 in order to leave via AA3 as a flow d1 and in order to be compressed by the first compressor C1 from P'1 to P"1, where P"1 lies in the range P'1 to P1. Thereafter, it leaves the first compressor C1 in the form of a two-phase mixture having a liquid phase as a flow d1*a* that is compressed substantially to P1 by the pump PP, and a gaseous phase as a flow d1*b* that is compressed at P1 by the second compressor C1A, and then cooled within the desuperheater DS, and then partially or totally condensed within the condenser H1, and finally separated once more within the separator R1A, as described above, for a new cycle, as described above.

In the variant implementation of FIG. 3, the expander D1 is a liquid-to-gas expander, whereas the expander D1A is a gas-to-gas expander.

The implementation of FIG. 3 is preferred since firstly the control valve VIA associated with the control valve V1 and the expander D1 enables two liquid phases to be mixed together and enables them to be vaporized under good conditions of stability, and secondly it does not require the use of a total condenser, thereby increasing the overall stability of the process and thus its industrial reliability. In this preferred variant, the liquid stream d1' represents about 95% by weight of the stream of the first refrigerant gas, while the gaseous stream d1" represents the complement, i.e. about 5%.

The condensers H0 and H1 and the cooler H2 may be constituted by water heat exchangers, e.g. exchanging heat with sea or river water, or cold air heat exchangers of the cooling tower type, known to the person skilled in the art.

The compositions of the first and second refrigerant fluids are associated with the technologies used in terms of cryogenic heat exchangers and condensers, and manufacturers and suppliers all recommend their own compositions. However these compositions are also closely associated with the composition of the natural gas that is to be liquefied, and the components of the refrigerant fluids are advantageously adjusted over time whenever the characteristics of the natural gas change in significant manner.

By way of example, the first refrigerant fluid operating in a loop in the heat exchanger EC1, and thus at ordinary temperature T0 (20° C. to 30° C.) down to a lowest temperature T1 of about −50° C., is constituted by the following mixture:

C1 (methane)≈2.5%
C2 (ethane/ethylene)≈60%
C3 (propane)≈15%
C4 (butane)≈20%
C5 (pentane)≈2.5%

Likewise, the second refrigerant fluid operating in a loop in the heat exchangers EC1, EC2, and EC3, and thus from T1=−50° C. approximately, down to a lowest temperature of T3=−165° C. approximately, is constituted by the following mixture:

N2 (nitrogen)≈5%
C1 (methane)≈45%
C2 (ethane/ethylene)≈37%
C3 (propane)≈13%

The mechanical power consumed for an annular production of 2.5 mega tonnes per year (Mt/y) in the installation as a whole is of the order of 85 megawatts (MW):

50 MW being injected via the compressor C2, generally by means of a first gas turbine (not shown); and 35 MW being injected via the compressors C1 and C1A, generally by means of a second gas turbine, with C1 absorbing substantially ⅔ of the power and C1A the remaining third.

These powers involved by the processes of the invention are of the same order and have substantially the same distribution as the powers involved in the prior art. In contrast, said processes of the invention are much more stable and reliable, and as a result provide an optimized industrial technique.

The invention is described above in the context of two-loop processes, comprising a "hot" first loop corresponding to the circuits S1-S1A-S1B operating in the heat exchanger EC1 (−50° C.), and a "cold" second loop corresponding to the circuits S2-S2A-S3 operating in the heat exchangers EC2 (−50° C.=>−120° C.) and EC3 (−120° C.=>−165° C.). However, similar processes exist in which the "hot" loop is identical, but the "cold" loop is replaced by two independent loops each having its own refrigerant fluid, in general a second loop operating in the heat exchanger EC2, i.e. from −50° C. to −120° C., while the third loop operates in the heat exchanger EC3, i.e. from −120° C. to −165° C. In all of these processes, and regardless of the type of cryogenic heat exchanger, the "hot" loop corresponding to the heat exchanger EC1 remains substantially the same as that described with reference to FIG. 1A. Thus the invention applies to practically all processes for liquefying natural gas using multiple independent loops and changes of phase.

The invention claimed is:

1. A process for liquefying natural gas comprising a majority of methane, and other components, the other components essentially comprising nitrogen and C-2 to C-4 alkanes, in which said natural gas is liquefied by causing a gaseous stream of said natural gas at a pressure P0 greater than or equal to atmospheric pressure, to flow in at least one first cryogenic heat exchanger in indirect contact with at least one first stream of a first refrigerant fluid comprising a first mixture of compounds circulating in at least one first closed circuit loop with change of phase, said at least one first stream of first refrigerant fluid entering a first one of the at least one first cryogenic heat exchangers via a first inlet at a hot end of said first one of the at least one first cryogenic heat exchangers at a pressure P1 greater than P0 and at a temperature substantially equal to a temperature T0 which is the inlet temperature of the natural gas entering said first one of the at least one first cryogenic heat exchangers, said at least one first stream of first refrigerant fluid passing through said first one of the at least one first cryogenic heat exchangers as a co-current stream with said gaseous stream of natural gas and leaving said first one of the at least one cryogenic heat exchangers via a cold end in the liquid state, said first stream of first refrigerant fluid in the liquid state being expanded by a first expander at a cold end of said first one of the at least one cryogenic heat exchangers in order to return to the gaseous state at a pressure P'1 less than P1 and at a temperature T1 less than T0 inside said first one of the at least one cryogenic heat exchangers at said cold end, then leaving said first one of the at least one cryogenic heat exchangers via an outlet orifice at said hot end in the gaseous state and substantially at the temperature T0, said at least one first stream of first refrigerant fluid in the gaseous state then being reliquefied at least in part and taken to the first inlet at said hot end of said first one of the at least one cryogenic heat exchangers to constitute a feed of said at least one first stream of first refrigerant fluid in the liquid state thus circulating in a closed circuit, the liquefaction of said at least one first stream of first refrigerant fluid in the gaseous state comprising first compression in a first compressor followed by first partial condensation in a first condenser, and phase separation in a first separator tank separating a first liquid phase of first refrigerant fluid and a first gaseous phase of first refrigerant fluid, said first liquid phase of first refrigerant fluid at a low outlet from said first separator tank being taken by a pump substantially at the pressure P1 at least in part to said first inlet at said hot end of said first one of the at least one cryogenic heat exchangers in order to constitute said at least one first stream of first refrigerant fluid in the liquid state, said first gaseous phase of said first refrigerant fluid at a high outlet from said first separator tank being compressed substantially to the pressure P1 by a second compressor and then condensed at least in part in a second condenser, wherein said first gaseous phase of said first refrigerant fluid at the outlet from said second compressor is cooled in a desuperheater by coming into contact with a portion of said first liquid phase of first refrigerant fluid at the outlet from said first separator tank, said portion of first liquid phase of the first refrigerant fluid being micronized and vaporized within said desuperheater, prior to said condensation in said second condenser.

2. The process according to claim 1, wherein said portion of first liquid phase of first refrigerant fluid represents less than 10% by weight of the total flow of a total of said first liquid phase of first refrigerant fluid, so as to be vaporized entirely within said desuperheater, and so that after the first liquid phase of first refrigerant fluid has been so-vaporized, the first refrigerant fluid at the outlet from said desuperheater is entirely in the gaseous phase prior to being at least partially condensed in said second condenser, the flow of said first liquid phase portion of first refrigerant fluid being adjusted by at least one control valve.

3. The process according to claim 1, wherein said first gaseous phase of said first refrigerant fluid after being cooled in said desuperheater and condensed in a second condenser, is taken at least in part to a second inlet at the hot end of said first one of the at least one first cryogenic heat exchangers to form a second stream of first refrigerant fluid passing through said first cryogenic heat exchangers as a co-current stream with said stream of natural gas and remaining in the gaseous state and being expanded by a second expander at the cold end of said first one of the at least one first cryogenic heat exchangers to return to the gaseous state at a pressure P'1 less than P1 and at a temperature T1 less than T0 inside said first one of the at least one first cryogenic heat exchangers beside the cold end and then being mixed with said first stream of first refrigerant fluid expanded by said first expander in the gaseous state inside said first one of the at least one first cryogenic heat exchangers, the mixture of said first and second streams in the gaseous state leaving said outlet orifice at the hot end said first one of the at least one first cryogenic heat exchangers substantially at the temperature T0, to be taken subsequently to said first compressor with said first stream of first refrigerant fluid in the gaseous state at the outlet from the hot end of said first one of the at least one first cryogenic heat exchangers, to form said first stream of first refrigerant fluid in the gaseous state to be liquefied by a new cycle of said liquefaction, said new cycle comprising first compression in said first compressor.

4. The process according to claim 3, wherein said gaseous phase of first refrigerant fluid cooled in said desuperheater is totally condensed in said second condenser, and is then taken in the liquid state substantially at said pressure P1 and at said temperature T0 to said hot end of said first one of the at least one cryogenic heat exchangers to pass therethrough as a co-current stream with said stream of natural gas mixed with said at least one first stream of first refrigerant fluid in the liquid state, to form the second stream of first refrigerant fluid in the liquid state passing through said first one of the at least one cryogenic heat exchangers as a co-current stream with said natural gas stream and leaving said first one of the at least one cryogenic heat exchangers in the liquid state and being expanded by the second expander at the cold end of said first one of the at least one cryogenic heat exchangers in order to return to the gaseous state at a pressure P'1 less than P1 and at the temperature T1 less than T0 inside said first one of the at least one cryogenic heat exchangers next to the cold end of said first one of the at least one cryogenic heat exchangers, and then leaving said first one of the at least one cryogenic heat exchangers via the outlet orifice at the hot end of said first one of the at least one cryogenic heat exchangers in the gaseous state and substantially at the temperature T0 in order to be taken to said first compressor with said first stream of first refrigerant fluid in the gaseous state at the outlet from the hot end of said first one of the at least one cryogenic heat exchangers.

5. The process according to claim 1, wherein said natural gas leaving said cold end of said first one of the at least one cryogenic heat exchangers at a temperature substantially equal to T1 is cooled and at least partially liquefied in a second cryogenic heat exchanger having a hot end and a cold end, in which said natural gas for liquefying is liquefied by causing the stream of said natural gas to flow in indirect contact with at least one first stream of a second refrigerant fluid comprising a second mixture of compounds flowing in at least one second closed circuit loop with phase change, said first stream of second refrigerant fluid entering into said second cryogenic heat exchanger at a first inlet at the hot end of said second cryogenic heat exchanger at a temperature substantially equal to T1 and at a pressure P2, passing through said second cryogenic heat exchanger as a co-current stream with said stream of natural gas, and leaving said second cryogenic heat exchanger in the liquid state at the cold end of said second cryogenic heat exchanger, said first stream of second refrigerant fluid in the liquid state being expanded by a third expander at the cold end of said second cryogenic heat exchanger in order to return to the gaseous state at a pressure P'2 less than P2 and at a temperature T2 less than T1 within said second cryogenic heat exchanger at the cold end of said second cryogenic heat exchanger, and then leaving via an outlet orifice at the hot end of said second cryogenic heat exchanger in the gaseous state substantially at the temperature T1, said first stream of second fluid in the gaseous state then being partially reliquefied and taken to the inlet at the hot end of said second cryogenic heat exchanger in order to constitute the feed of said first stream of second cooling fluid in the liquid state thus circulating in a closed loop, the liquefaction of said first stream of the second refrigerant fluid in the gaseous state comprising compression to the pressure P2 by a third compressor and then cooling substantially to T0 in a cooling heat exchanger, with said first stream of second cooling fluid in the gaseous state then being taken to an inlet at the hot end of said first one of the at least one first cryogenic heat exchangers and being output via the cold end of said first one of the at least one first cryogenic heat exchanger in the partially liquefied state substantially at the temperature T1, and then being subjected to phase separation in a third separator tank having a low outlet and a high outlet, said third separator tank separating a liquid phase of the second refrigerant fluid from a gaseous phase of the second refrigerant fluid, the liquid phase of the second refrigerant fluid at the low outlet from said third separator tank being taken substantially at the temperature T1 and the pressure P2 to said first inlet at the hot end of said second cryogenic heat exchanger in order to form said first stream of second refrigerant fluid in the liquid state, said gaseous phase of said second refrigerant fluid at the high outlet from said third separator tank being taken to a second inlet at the hot end of said second cryogenic heat exchanger substantially at the temperature T1 and at the pressure P2 in order to form a second stream of second refrigerant fluid passing through said second cryogenic heat exchanger in the gaseous state and leaving at the cold end of said second cryogenic heat exchanger prior to leaving from an outlet orifice at the hot end of said second cryogenic heat exchanger in order to be taken to said third compressor with said first stream of second fluid in the gaseous state.

6. The process according to claim 5, wherein said natural gas leaving the cold end of said second cryogenic heat exchanger is cooled and fully liquefied at a temperature T3 lower than T2 in a third cryogenic heat exchanger having a hot end and a cold end, in which said natural gas flows in indirect contact as a co-current stream with at least one third stream of second refrigerant fluid fed by said second stream of second refrigerant fluid in the gaseous state leaving the cold end of said second cryogenic heat exchanger substantially at the temperature T2 and at the pressure P2, said third stream of second refrigerant fluid passing in the gaseous state through said third cryogenic heat exchanger as a co-current stream with said stream of liquefied natural gas and leaving said third cryogenic heat exchanger substantially in the gaseous state and being expanded by a fourth expander at the cold end of said third cryogenic heat exchanger to return to the gaseous state at a pressure P2' less than P2 and at a temperature T3 less than T2 within said third cryogenic heat exchanger proximate the cold end of the third cryogenic heat exchanger, and then leaving said third cryogenic heat exchanger via an orifice at the hot end of said third cryogenic heat exchanger in the gaseous state and substantially at the temperature T2 in order subsequently to be taken to an orifice at the cold end of said second cryogenic heat exchanger in order to leave said second cryogenic heat exchanger via an orifice at the hot end of said second heat exchanger in order to be taken to said third compressor together with said first stream of second fluid in the gaseous state.

7. The process according to claim 1, wherein said first expander comprises a valve with an opening percentage that is suitable for being controlled in real time.

8. The process according to claim 1, wherein the compounds of the natural gas and of the first refrigerant fluid are selected from methane, nitrogen, ethane, ethylene, propane, butane, and pentane.

9. The process according to claim 1, wherein the composition of the natural gas lies within the following ranges for a total of 100% of the following compounds:

methane 80% to 100%;
nitrogen 0% to 20%;
ethane 0% to 20%;
propane 0% to 20%; and
butane 0% to 20%.

10. The process according to claim 1, wherein the composition of the first refrigerant fluid lies within the following ranges for a total of 100% of the following compounds:

methane 2% to 50%;
nitrogen 0% to 10%;
ethane and/or ethylene 20% to 75%;
propane 5% to 20%;
butane 0% to 30%; and
pentate 0% to 10%.

11. The process according to claim 6, wherein the temperatures have the following values:

T0: 10° C. to 60° C.;
T1: −30° C. to −70° C.;
T2: −100° C. to −140° C.; and
T3: −160° C. to −170° C.

12. The process according to claim 6, wherein the pressures have the following values:

P0: 0.5 MPa to 10 MPa;
P1: 1.5 MPa to 10 MPa; and
P2: 2.5 MPa to 10 MPa.

13. An installation on board a floating support for performing a process for liquefying natural gas, wherein the installation comprises:

at least one first cryogenic heat exchanger having an enclosure, a cold end, a hot end, a first inlet and a second inlet, and comprising:
- a first duct having an inlet and a cold outlet, the first duct passing through said at least one first cryogenic heat exchanger and suitable for causing a first stream of first refrigerant fluid in the liquid state to flow therethrough;
- a second duct having an inlet and a cold outlet, the cold duct passing through said at least one first cryogenic heat exchanger and suitable for causing a second stream of first refrigerant fluid in the gaseous or liquid state to flow therethrough; and
- a third duct having a cold outlet, the third duct passing through said at least one first cryogenic heat exchanger and suitable for causing said natural gas to flow therethrough;

a first expander between the cold outlet of said first duct and the first inlet at the cold end of the enclosure of said at least one first cryogenic heat exchanger;

a second expander between the cold outlet of said second duct and the second inlet at the cold end of an enclosure of said at least one first cryogenic heat exchanger;

a first compressor having an inlet, an outlet, and a connection pipe, the connection pipe located between an outlet at the hot end of the enclosure of said at least one first cryogenic heat exchanger and the inlet of said first compressor;

a first condenser having an inlet, an outlet, and a connection pipe, the connection pipe located between the outlet of said first compressor and the inlet of said first condenser;

a first separator tank having an inlet, an outlet, and a connection pipe, the connection pipe located between the outlet of said first condenser and said first separator tank;

a second compressor having an inlet, an outlet, and a connection pipe, the connection pipe located between the outlet of said first separator tank and the inlet of said second compressor;

a desuperheater having an inlet, an outlet, and a connection pipe, the connection pipe located between an outlet of said second compressor and an inlet of the desuperheater for admitting gas into said desuperheater;

a second condenser having an inlet, an outlet, and a connection pipe, the connection pipe located between an outlet of said desuperheater and an inlet of said second condenser;

a pump having an outlet and an inlet and a first connection pipe the first connection pipe located between the outlet of said first separator tank and said pump, and a second connection pipe fitted with a first valve between the outlet from said pump and the inlet of the desuperheater for admitting liquid into said desuperheater;

at least one return pipe located between the outlet of said pump and the inlet of said first duct for carrying first refrigerant fluid; and at least one circulation pipe located between the outlet of said second condenser and the inlet of said second duct for carrying first refrigerant fluid.

14. The installation according to claim 13, further comprising:

a second separator tank having an inlet, a top outlet, a bottom outlet, and a connection pipe, the connection pipe located between the outlet of said second condenser and said second separator tank;

a connection pipe between the top outlet from said second separator tank and the inlet of said second duct for first refrigerant fluid;

a connection pipe between the bottom outlet of said second separator tank and the inlet of said first duct for carrying first refrigerant fluid; and a connection pipe fitted with a second valve and located between the outlet from said pump upstream from said first valve, and a junction with said connection pipe between the bottom outlet of said second separator tank and the inlet of said first duct for carrying first refrigerant fluid.

15. The installation according to claim 13, further comprising:

a fourth duct having an inlet and a cold outlet, the fourth duct having an hot end and passing through said at least one first cryogenic heat exchanger and suitable for causing a first stream of second refrigerant fluid in the gaseous or liquid state to flow;

a second cryogenic heat exchanger having an enclosure, a cold end, a hot end, a first inlet and a second inlet and comprising:

a fifth duct having an inlet and a cold outlet, the fifth duct of the second cryogenic heat exchanger passing through said second cryogenic heat exchanger and suitable for causing a first stream of second refrigerant fluid in the liquid state to flow therethrough;

a sixth duct having an inlet, and a cold outlet, the sixth duct of the second cryogenic heat exchanger passing through said second cryogenic heat exchanger and suitable for causing said first stream of second refrigerant fluid in the gaseous state to flow continuously therethrough; and a seventh duct having an inlet and a cold outlet, the sixth duct of the second cryogenic heat exchanger passing through said second cryogenic heat exchanger and suitable for causing said natural gas to flow continuously through said seventh duct passing through said at least one first cryogenic heat exchanger;

a third cryogenic heat exchanger having an enclosure, a cold end, a hot end, a first inlet and a second inlet, and comprising:

a first duct having an inlet and a cold outlet, the first duct of the third cryogenic heat exchanger passing through said third cryogenic heat exchanger and suitable for causing a second stream of first refrigerant fluid in the gaseous state to flow continuously from said second duct passing through said second cryogenic heat exchanger; and a second duct having an inlet and a cold outlet, the second duct of the third cryogenic heat exchanger passing through said third cryogenic heat exchanger suitable for causing said natural gas to flow continuously from said third duct passing through said second cryogenic heat exchanger;

a third separator tank having an inlet, a top outlet, and a bottom outlet;

a connection pipe between the cold end of said fourth duct of said first cryogenic heat exchanger and said third separator tank;

a connection pipe between the bottom outlet of said third separator tank and an inlet orifice at the hot end of said second cryogenic heat exchanger;

a connection pipe between a top outlet from said third separator tank and a hot end of said second duct of said second cryogenic heat exchanger;

a third expander between the cold outlet of said first duct of said second cryogenic heat exchanger and an inlet at the cold end of the enclosure of said second cryogenic heat exchanger;

a third compressor having an inlet, and an outlet, and a connection pipe, the connection pipe located between an outlet at the hot end of the enclosure of said second cryogenic heat exchanger and the inlet of said third compressor;

a gas cooling heat exchanger having an inlet and an outlet, and connection pipe located between the outlet of said third compressor and the inlet of said gas cooling heat exchanger;

a connection pipe located between the outlet of said gas cooling heat exchanger and the inlet at the hot end of said fourth duct of said first cryogenic heat exchanger;

a fourth expander between the cold outlet of said first duct of said third cryogenic heat exchanger and an inlet at the cold end of the enclosure of said third cryogenic heat exchanger; and a connection pipe located between an outlet at the hot end of the enclosure of said third cryogenic heat exchanger and a second inlet at the cold end of the enclosure of said second cryogenic heat exchanger.

16. The process according to claim 3, wherein said gaseous phase of first refrigerant fluid cooled at the outlet from said desuperheater is condensed in part in said second condenser, and then a second phase separation is performed in a second separator tank having a low outlet, the second separator tank separating a second liquid phase of first refrigerant fluid from a second gaseous phase of first refrigerant fluid, said second liquid phase of first refrigerant fluid at the low outlet from said second separator tank being mixed with a remainder of said first liquid phase of first refrigerant fluid and taken to said first inlet at the hot end of said first one of the at least one cryogenic heat exchangers to form said at least one first stream of first refrigerant fluid in the liquid state substantially at the temperature T0 and substantially at the pressure P1, and said second gaseous phase at a high outlet from the second separator tank being taken at said pressure P1 and substantially at the temperature T0 to the second inlet at the hot end of said first one of the at least one cryogenic heat exchangers to form a second stream of first refrigerant fluid passing through said first one of at least one cryogenic heat exchangers in the gaseous state as a co-current stream with said stream of natural gas, and leaving said first one of the at least one cryogenic heat exchangers in the gaseous state and being expanded by the second expander at the cold end of said first one of the at least one cryogenic heat exchangers to return to the gaseous state at a pressure P'1 less than P1 and at a temperature T1 less than T0 inside said first one of the at least one cryogenic heat exchangers next to said cold end, and then leaving via said outlet orifice at said hot end of said first one of the at least one cryogenic heat exchangers in the gaseous state and substantially at the temperature T0, to be taken subsequently to said first compressor with said at least one first stream of first refrigerant fluid in the gaseous state at the outlet from said hot end of said first one of the at least one cryogenic heat exchangers.

* * * * *